United States Patent [19]

Blank

[11] 3,941,360

[45] Mar. 2, 1976

[54] MECHANICAL SKIMMER

[75] Inventor: Albert I. Blank, Lyndhurst, Ohio

[73] Assignee: Chase Brass & Copper Co., Incorporated, Cleveland, Ohio

[22] Filed: Dec. 16, 1974

[21] Appl. No.: 532,854

[52] U.S. Cl. ..... 266/37

[51] Int. Cl.[2] ..... C21C 7/00

[58] Field of Search ..... 266/37, 1 R; 210/523, 527, 210/525

[56] References Cited

UNITED STATES PATENTS 3,360,254 12/1967 Hellmund ..... 266/37 X

*Primary Examiner*—Gerald A. Dost

[57] ABSTRACT

A device for removing dross from the surface of molten metal in a furnace is disclosed which includes a dross pusher head and means for reciprocating the pusher head across the molten metal in the furnace from one side of the furnace to the other, in order to push the dross on the top surface of the molten metal towards one side of the furnace. A pivotally mounted scoop is mounted on or adjacent the furnace along the side to which dross is pushed by the pusher head, and has an open side which is normally positioned at least partly within the furnace opposite the pusher head to receive dross pushed by the head. Means are provided for pivoting the scoop from its normal position within the furnace through a predetermined angle to a tilted position above the upper edge of the furnace, thereby to discharge dross contained in the scoop into a receptacle or conveyor located outside of the furnace.

10 Claims, 2 Drawing Figures

MECHANICAL SKIMMER

Figure 1:
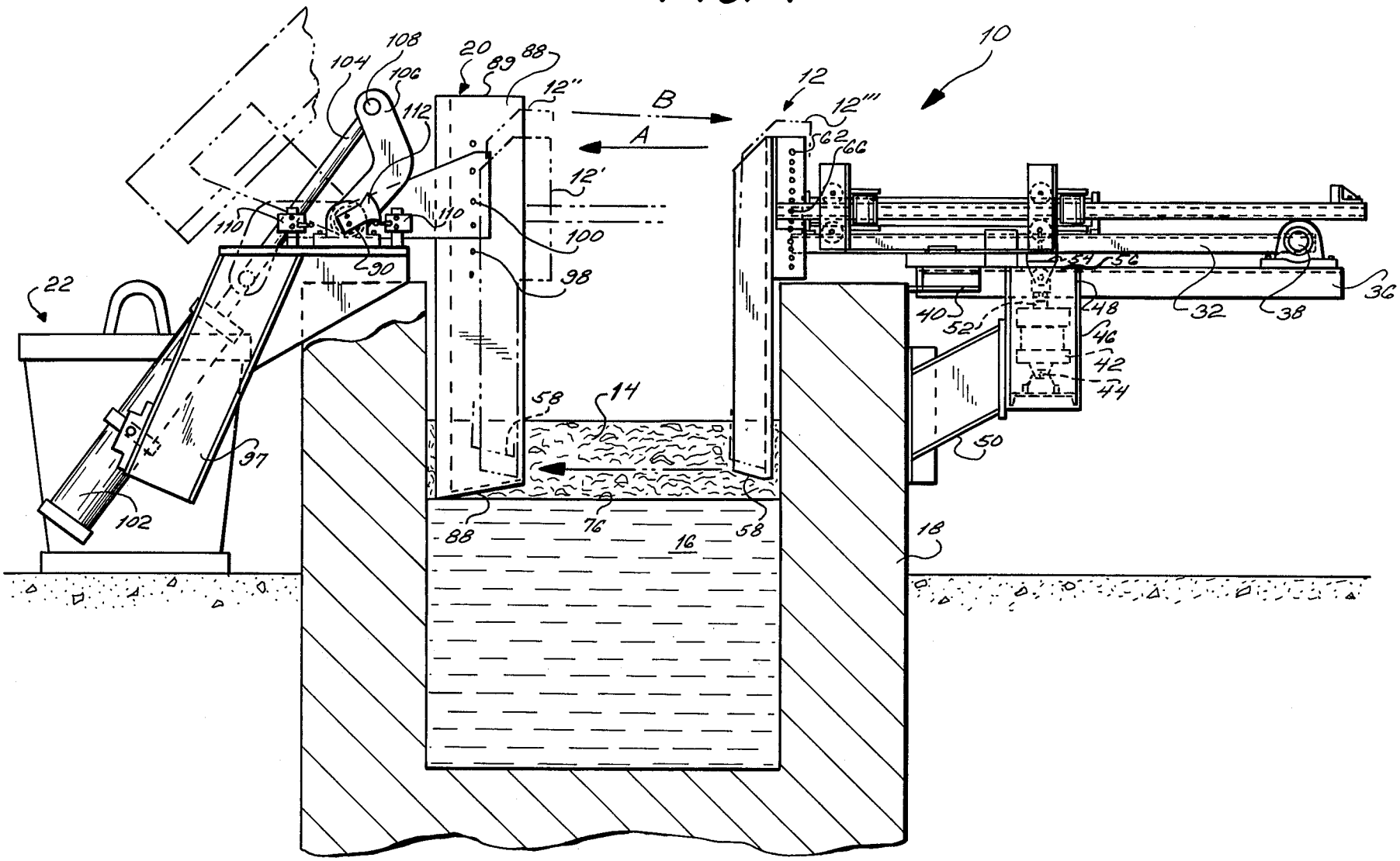

The present invention relates to a mechanical skimmer mechanism for use with metallurgical furnaces, and more particularly to a mechanical skimmer which is adapted to automatically remove overlying dross or the like from the surface of liquid metal in a furnace, before the furnace is poured or tapped.

In the treatment or melting of common metals and alloys, as for example in the melting of copper base metals such as brasses, a layer of dross is usually formed on the surface of the molten metal in the furnace. This typically occurs in air melting operations in electric induction or fuel fired furnaces. The nature and amount of dross formed on the molten metal varies according to the composition of the metal and is typically controlled, to varying degrees, by the use of protective covers and atmospheres. However, whatever dross does form under such circumstances still must be periodically removed from the furnace, particularly prior to pouring of the liquid metal in the case of lip-pour furnaces.

Heretofore the common method of skimming dross from the furnace is by the use of a manual metal skimmer to rake or ladle the dross out of the furnace. Such manual skimming operations are difficult and time consuming at best. They are also disagreeable because of exposure to heat and noxious fumes.

Although certain types of mechanical skimmer mechanisms have been previously proposed, such as for example the rake arrangements shown in U.S. Pat. Nos. 3,610,603 and 3,659,833, such mechanisms simply rake or push the dross or slag over the edge of the furnace into a receptacle. Such arrangements require careful control of the level of molten metal in the furnace and require the dross or slag to be moved over the edge of the furnace with the possibility of spillage along the sides of the furnace or damage to the furnace itself.

Accordingly, it is an object of the present invention to provide a mechanical skimmer for conveniently and automatically removing dross or slag from the surface of molten metal in a furnace.

Another object of the present invention is to provide a mechanical skimmer which will collect dross within the confines of the furnace and lift the dross therefrom for discharge to an adjacent receptacle or conveyor.

Another object of the present invention is to provide a mechanical skimmer for removing dross from a furnace, which skimmer is relatively simple in construction and economical in manufacture.

A further object of the present invention is to provide a mechanical dross skimmer which is durable in operation and simple to manufacture.

In accordance with an aspect of the present invention, a mechanical skimmer for automatically removing dross from the surface of molten metal in a furnace having an open upper end includes an adjustably mounted dross pusher head which is normally located within the furnace and adapted to push dross from one side of the furnace to the other. The pusher head is reciprocated across the top of the molten metal, at a predetermined elevation with respect to the level of the molten metal in the furnace, by means of a pneumatic ram or the like which is movably mounted on the furnace. The movable mounting of this ram—and thus of the pusher head—allows the vertical position of the head to be varied with respect to the level of molten metal in the furnace so the head can be lifted out of the dross when it is returned to its initial position after a dross pushing operation. The adjustable mounting of the head, on the other hand, allows the depth of insertion of the pushing head into the dross to be controlled in order that a residual layer of dross is left on the metal during the dross removal operation, thereby to protect the molten metal in the furnace against oxidation.

A hollow scoop, having an open side, is pivotally mounted on the furnace at a position opposite the pushing head and is normally positioned to extend into the furnace with its open side facing the pusher head in order to receive dross pushed by the head. Means are provided for pivoting the scoop from its position in the furnace through a predetermined angle to a tilted position over the upper end of the furnace, thereby to discharge the dross contained in the scoop over the upper end of the furnace and into an adjacent receptacle or conveyor. This eliminates the need to move the dross over the edge of the furnace itself, as is required in the above mentioned skimmer patents.

The skimmer of the present invention is controlled in an automatically operable sequence so that the pusher head is moved across the surface of the molten metal to push the dross into the scoop and is retracted with the head removed from the dross, to its original position, as the scoop is pivoted to its tilted position in order to discharge the dross therefrom. Timing means holds the scoop in its tilted position for a predetermined period of time sufficient to enable the dross to flow therefrom, and the scoop returns to its original position, within the furnace, before the pusher head begins the next cycle of operation to move dross towards the scoop.

Figure 2:
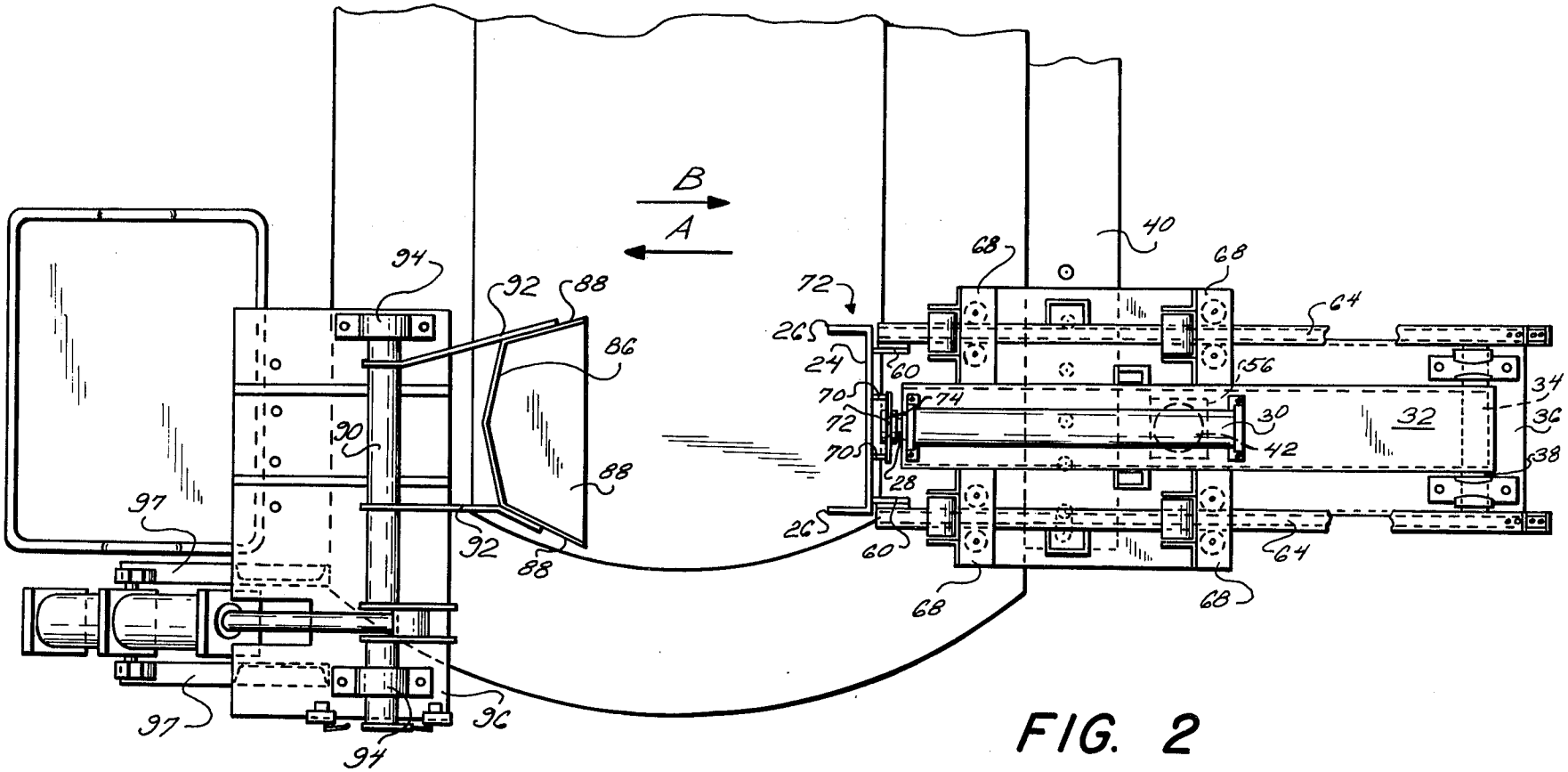

The above and other objects, features and advantages of this invention, will be apparent in the following detailed description of an illustrative embodiment thereof, which is to be read in connection with the accompanying drawing, wherein:

FIG. 1 is an elevational view illustrating the skimmer mechanism of the present invention in conjunction with a conventional furnace; and FIG. 2 is a schematic plan view of the arrangement shown in FIG. 1.

Referring now to the drawing in detail, and initially to FIG. 1 thereof, it will be seen that the mechanical skimmer 10 of the present invention includes a pusher head 12 which is adapted to be inserted in a layer of dross 14 formed on the surface of molten metal 16 in a conventional melting furnace 18. The pusher head cooperates with a scoop 20 which is pivotally mounted for movement between a first position, shown in solid lines in FIG. 1, wherein the scoop is within the furnace 18, and a second position, shown in phantom lines in FIG. 1, wherein dross pushed into the scoop by the head 12 is discharged over the upper edge of the furnace into a receptacle or conveyor 22. The cycle of operation of the apparatus preferably is automatically controlled for operation in a predetermined sequence, as described hereinafter, by an electrical control system (not shown) which, as would be apparent to those skilled in the art, will automatically sequence operation of the various pneumatic rams used in the apparatus.

Pusher head 12, as seen in FIG. 2, consists of a generally U-shaped element having a bight portion 24 and a pair of side legs or flanges 26 which retain the dross in front of the bight portion 24 as the pusher is moved across the surface of the molten metal in furnace 18, in the direction of the arrow A. The head is operatively connected to the actuator rod 28 of a double acting pneumatic cylinder 30. The latter is operable to reciprocate the head across furnace 18, towards and away from scoop 20.

Cylinder 30 is rigidly mounted, in any convenient manner, on a first support plate 32 which, in turn, is pivotally mounted at its rear end 34 on a second support plate 36 by a pivot pin 38 or the like. The plate 36 is rigidly secured to a shelf 40 on furnace 18 so that the entire pusher head assembly is rigidly mounted on the furnace. However, the pivotal mounting of the support plate 36 for cylinder 30 allows the position of the pusher head to be varied with respect to the level of dross in the furnace during the cycle of operation of the apparatus, as described hereinafter.

The vertical movement of head 12 is controlled by a second double acting pneumatic ram or cylinder 42 which is pivotally mounted by a pivot pin 44 or the like on a rigid frame 46. The latter is secured at its upper end 48 to the lower side of plate 36 and has a frame member 50 at its lower end which is secured to the side of furnace 18. The actuator rod 52 of ram 42 is pivotally connected to a bracket 54 secured to the bottom of support plate 32, which bracket extends through an opening 56 in plate 36. By this arrangement the plate 32 can be pivoted, upon operation or extension of ram 42, during the cycle of operation of the apparatus, in order to selectively lift the pusher head out of the dross.

Thus, when it is desired to move dross 14 into the scoop 20, the pusher head 12 is moved in a straight line from the solid line position thereof (shown at the right in FIG. 1) to the lower dotted line position 12' thereof at the left in furnace 18, by the extension of the actuator rod 28 upon the operation of the double acting ram 30. This movement of the pusher head will push the dross towards the scoop and into the open side thereof, as described hereinafter. When the operation is completed the head 12 is retracted and returned to its original position by ram 30. Preferably, once the pusher head 12 has reached its dotted line position 12' in FIG. 1, the ram 42 is actuated in order to pivot the entire assembly of the pusher head 12, ram 30, and plate 32 about pivot pin 38, thereby to raise the lower end 58 of the pusher head out of the layer of dross and raise the head to the position 12''. Thus, as ram 30 is actuated to retract the pusher head to the right, in the direction of arrow B in FIG. 1, to its original position, the head 12 does not disturb the residual layer of dross remaining in the furnace. Once the ram 30 is fully retracted and the pusher head is in the position 12''' in FIG. 1, the double acting ram 42 is operated in the reverse direction to lower the head 12 to its solid line position, thereby reinserting the lower edge 58 of the pusher head into the layer of dross.

Pusher head 12 is adjustably mounted on the ram 30 and plate 32 so that the depth of insertion of the head into the layer of dross can be adjusted in order to leave a residual layer of dross on the molten metal in the furnace, after the pushing operation, in order to prevent or limit oxidation of the metal. As seen most clearly in FIG. 2 the pusher head has a pair of support plates 60 which are secured to its rear face and extend rearwardly towards ram 30. These plates have a series of vertically spaced apertures 62 formed therein by which the head 12 is secured to a pair of guide rods 64 with bolts 66 or the like. The guide rods are slidably mounted on the support plate 32 for movement in the horizontal direction, in four roller support assemblies 68 mounted rigidly on plate 32. In this manner the guide rods guide and support the head 12 as it is moved across the furnace by ram 30.

Pusher head 12 also includes a pair of L-shaped guide members 70 secured to its rear face, which guide members define a slot 72 therebetween. A bushing or grooved mounting ring 74, secured to the free end of actuator rod 28, is received in this slot to secure the head 12 against movement in the horizontal direction with respect to the actuator rod, while allowing vertical movement and adjustment of the head with respect to the actuator rod. Thus, in order to adjust the vertical position of head 12 with respect to ram 30 (and thus with respect to the liquid level in the furnace) the bolts 66 are released, the head 12 is moved vertically to the desired position, and then the bolts 66 are reinserted and secured to the guide rods 64 and the appropriate holes 62 in plates 60. With the bolts locked in position by nuts, or the like, in the conventional manner, the head 12 is effectively rigidly secured to the actuator rod 28 of ram 30 for movement therewith. As mentioned, by varying the position of the pusher head on the guide rods, the depth of the residual layer of dross left on the surface 76 of the molten metal below the lower end 58 of the head can be varied.

It will be appreciated that the stroke length of the ram 30 which drives pusher head 12, and the operation of ram 42 can be controlled in various ways, such as for example by the use of pneumatic or electrical limit and control switches, as will be apparent to those skilled in the art.

Scoop 20, which receives the dross pushed by head 12, has a base portion 86 and three sides 88. The fourth side 89 of the generally rectangular scoop is open to permit dross contained therein to be poured out of the scoop upon tilting, as described hereinafter. As seen most clearly in FIG. 2 the base 86 of the scoop is recessed in a generally V-shaped configuration, while the vertical sides 88 flare outwardly from the base and the bottom side 88 is inclined slightly upwardly (FIG. 1). The front side or face of the scoop, opposite base 86, is open and faces the pusher 12. The width of the scoop is slightly greater than the width of the pusher head so that all of the dross pushed by the head will be received within the scoop.

Scoop 20 is rigidly secured to a shaft 90 by means of a pair of brackets 92. The shaft, in turn, is rotatably mounted in bearings 94 or the like, which are secured to a support plate 96, rigidly mounted on furnace 18 in any convenient manner. The depth of insertion of scoop 20 into the dross layer is adjustable in a manner similar to that of pusher head 12. That is, the vertical sides 88 of the scoop have a series of vertically aligned holes 98 formed therein which receive bolts 100 for securing the scoop to the brackets 92. Thus, to vary the vertical position of the scoop all that is required is that the bolts 100 be secured in different mounting holes 98.

A double acting pneumatic ram 102 is pivotally mounted on the support channel 97 along furnace 18 and has an actuator rod 104 which is operatively connected to shaft 90 by a crank 106. The latter is rigidly secured at one end to shaft 90 and is pivotally connected by a pin 108 to the actuator rod 104. Actuation of the double acting ram 102 will cause the scoop 20 to pivot between its solid line position in FIG. 1 and its dotted line position, wherein the scoop is tilted over the upper edge of the furnace 18 to allow dross pushed into the scoop by the pusher head 12 to be discharged through the open side 89 thereof. The angle of tilt of the scoop, i.e. the amount of rotation caused by actuation of ram 102 is adjustable, in any convenient manner, as for example by the use of electrical limit switches. In the embodiment of the invention shown in FIG. 1, a pair of limit switches 110 are vertically adjustably mounted on plate 96 and have actuator arms for engaging an actuator plate 112 rigidly mounted on shaft 90. It will be apparent that by adjusting the vertical position of the switches on plate 96 the angle of tilt of the scoop can be varied or adjusted to the desired value.

In addition, the control means or circuit which controls the operation of the various rams, and in particular ram 102, preferably includes timing means which will allow a dwell period for the scoop in its tilted phantom line position of FIG. 1, during which dwell period dross in scoop 20 will flow, under the influence of gravity, into the receptacle or conveyor 22. At the end of the selected dwell time period, the ram 102 is again actuated to return the scoop to its vertical position.

In operation the scoop 20 is initially positioned in the vertical solid line position shown in FIG. 1 and the pusher head 12 is in its solid line position. The relative vertical positions of the scoop and pusher head with respect to each other and to the liquid level in the furnace are initially adjusted, as desired, by adjusting the mounting of scoop 20 in brackets 92 and by adjusting the mounting of head 12 on guide rods 64. This adjustment is made so that movement of the pusher head across the furnace will leave a residual layer of dross, of a predetermined depth, on the molten metal.

Once the depth of insertion of the head 12 and scoop 20 is adjusted in this manner, the air cylinder 30 is actuated to extend actuator rod 28 and move pusher head 12 to its phantom line position 12' adjacent scoop 20. Movement of the head in this manner pushes the dross on the surface of the molten metal ahead of the pusher head into the scoop 20 where it is captured between the side walls 88 of the scoop. Once the extreme limit of movement of the head 12 is reached, the ram 42 is actuated to pivot the head 12 to its phantom line position 12'', thereby raising the head 12 out of the layer of dross. Once the head 12 is raised in this manner the ram 30 is actuated to retract the head in the direction B to its initial position, as indicated in phantom lines 12''' in FIG. 1. Once the fully retracted position of the pusher head 12 is reached, the ram 42 is actuated to lower support plate 32 and thus insert the pusher head 12 into the layer of dross.

After the pusher head 12 is retracted, the ram 102 is actuated in order to pivot the scoop 20 from its solid line position to its phantom line position. Once the scoop has been rotated through the preselected angle, as determined by limit switches 110, the scoop remains in its tilted position over the edge of the furnace for the preselected dwell time. During this period of time the dross pushed into the scoop flows therefrom out of the open side 89 into the receptacle 22. Once the dwell time has elapsed, the ram 102 is reactivated to return the scoop to its solid line position. The skimming mechanism is then in condition for another cycle of operation. The cycle of operation can be controlled automatically in any desired manner by appropriate control means or electrical circuit as will be apparent to those skilled in the art so that the pusher head 12 commences movement either immediately upon return of the scoop 20 to its solid line position or after a preselected time period, depending upon the process and metal being treated in the furnace 18.

It is noted that in the illustrative embodiment of the invention the furnace 18 is shown as being generally rectangular in plan with the pusher head 12 and scoop 20 mounted in fixed positions adjacent one end thereof. This arrangement provides for satisfactory removal of dross from the entire surface of the furnace since dross is a flowable material. That is, when dross is removed from the end of the furnace upon actuation of head 12 and scoop 20, some of the dross in the remainder of the furnace will flow into the space between the head and the scoop. Thus dross from the entire furnace can be continuously removed only at one end of the furnace while a satisfactory dross level throughout the furnace is maintained. In some furnaces it may be necessary to skim a larger area of the surface to obtain proper removal of dross.

Although an illustrative embodiment of the present invention has been described herein with reference to the accompanying drawing, it will be apparent that various changes and modifications can be effected therein by those skilled in the art without departing from the scope or spirit of this invention.

Accordingly, it will be appreciated that a relatively simple and inexpensively constructed mechanical skimmer is provided which, unlike manual skimming, removes dross at regular frequent intervals and does so without disturbing the molten metal below the dross layer since the skimmer can be adjusted to leave any desired thickness of residual dross on the melt. Thus, it reduces loss of volatile constituents, such as zinc from molten brass. This effects a cost saving and also reduces the amount of volatile effluent, which is beneficial in respect to air pollution abatement. Moreover, since the skimmer is fully automatic it does not require attention by an operator and thus reduces costs since it eliminates the need for manual skimming.

What is claimed is:

1. A device for removing dross from the surface of molten metal in a furnace comprising, a dross pusher head, means for reciprocating said pusher head across the molten metal in the furnace from one side of said furnace to the other; a pivotally mounted scoop having an open side and being normally positioned at least partially within said furnace opposite said pusher head to receive dross pushed by said head; and means for pivoting said scoop from said position within the furnace through a predetermined angle to discharge dross contained therein outside of the furnace.

2. The device as defined in claim 1 including means for raising said pusher head out of the layer of dross in the furnace after it has pushed dross into the scoop to hold the head out of the dross as it is moved away from said scoop and returned to its original position.

3. The device as defined in claim 2 including means for varying the vertical position of said head and said scoop with respect to the level of molten metal in the furnace.

4. A device for removing dross from the surface of molten metal in a furnace having an open upper end; said device comprising, a dross pusher head located within said furnace for pushing dross from one side of the furnace to an opposite side; means movably mounted on the furnace for cyclically reciprocating said pusher head across the surface of molten metal in the furnace from said one side to said opposite side and back to said one side; means for varying the vertical position of said reciprocating means and thus said pusher head with respect to the level of molten metal in said furnace; a hollow scoop, having an open side, pivotally mounted on said furnace at said opposite side thereof and normally positioned to extend into said furnace with its open side facing said pusher head to receive dross pushed by said head to said opposite side of the furnace; and means for pivoting said scoop from said position in the furnace through a predetermined angle to a tilted position over the open upper end of the furnace to discharge dross contained therein over said upper end of the furnace.

5. The device as defined in claim 4 including means for varying the vertical position of said scoop with respect to the level of molten metal in said furnace whereby the position of the scoop can be adjusted relative to the vertical position of the dross pusher head to receive dross pushed by said head.

6. The device as defined in claim 5 wherein said means for reciprocating said pusher head and said means for varying the vertical position thereof each comprise pneumatic rams.

7. The device as defined in claim 5 wherein said means for pivoting said scoop comprises a pneumatic ram operably connected to said scoop.

8. The device as defined in claim 5 wherein said means for varying the vertical position of said pusher head raises the pusher head out of the dross in the furnace when the head is moved from said opposite side of the furnace, adjacent the scoop, to said one side of the furnace and lowers the pusher head into the dross to a predetermined level when the head is returned to its initial position adjacent said one side of the furnace.

9. The device as defined in claim 5 wherein said scoop has a pair of vertical edge flanges, a bottom edge flange inserted in the dross when the scoop is in its normal position in the furnace, and a fourth open edge, opposite said bottom edge flange through which dross is poured from the scoop when the scoop is in its tilted position.

10. The device as defined in claim 9 wherein said pusher head is generally U-shaped and has a vertically extending bight portion and a pair of spaced vertically extending legs directed towards said scoop; the distance between said legs being less than the distance between said vertical edge flanges of the scoop.

* * * * *